US007171926B2

(12) United States Patent
Ito et al.

(10) Patent No.: US 7,171,926 B2
(45) Date of Patent: Feb. 6, 2007

(54) INTERNAL COMBUSTION ENGINE THERMOSTAT GUIDE

(75) Inventors: Norio Ito, Nagoya (JP); Takayoshi Ichihara, Fujisawa (JP)

(73) Assignees: Aichi Machine Industry Co., Ltd., Nagoya (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/203,120

(22) Filed: Aug. 15, 2005

(65) Prior Publication Data

US 2006/0042566 A1 Mar. 2, 2006

(30) Foreign Application Priority Data

Aug. 31, 2004 (JP) ..... 2004-253641

(51) Int. Cl.
*F01P 9/00* (2006.01)

(52) U.S. Cl. ..... 123/41.01; 123/41.29; 123/195 R

(58) Field of Classification Search ..... 123/41.01, 123/41.29, 195 R
See application file for complete search history.

(56) References Cited

U.S. PATENT DOCUMENTS 4,370,950 A * 2/1983 Furukubo ..... 123/41.08
5,201,285 A * 4/1993 McTaggart ..... 123/41.31
5,337,704 A * 8/1994 Roth ..... 123/41.1
5,353,757 A * 10/1994 Susa et al. ..... 123/41.29
6,457,652 B1 * 10/2002 Fukamachi et al. ..... 236/34.5
6,739,290 B2 * 5/2004 Iwasaki et al. ..... 123/41.05
6,883,470 B2 * 4/2005 Lee ..... 123/41.1

OTHER PUBLICATIONS

Fuji Heavy Industries Ltd., PLEO Manual vol. 1, (Oct. 1998), p. 2-70.

* cited by examiner

*Primary Examiner*—Stephen K. Cronin
*Assistant Examiner*—Ka Chun Leung
(74) *Attorney, Agent, or Firm*—Dennison, Schultz & MacDonald

(57) ABSTRACT

An internal combustion engine performing its cooling by means of coolant and being capable of detecting a temperature of the coolant accurately is to be provided. In this engine, there is mounted a water outlet 3 provided with a temperature detecting means 9 for detecting a temperature of the coolant after cooling the engine, and with a rib 7 and an upslope surface 8 both of which are capable of guiding the coolant to a temperature detecting portion 9*a* of the temperature detecting means 9.

5 Claims, 7 Drawing Sheets

INTERNAL COMBUSTION ENGINE THERMOSTAT GUIDE

FIELD OF THE INVENTION

The present invention relates to an internal combustion engine capable of detecting a temperature of the coolant accurately.

BACKGROUND OF THE INVENTION

One known arrangement of the internal combustion engine of this type is to have a water temperature sensor mounted on a water outlet to distribute and supply to a radiator, a throttle chamber, a heater core, etc the cooling water after cooling the cylinder head and cylinder block, as disclosed in the following non-patent document 1, for example. In this engine, the water temperature sensor detects a water temperature of the cooling water after cooling the cylinder head and cylinder block, and according to the detected temperature an electric cooling fan is rotated and controlled so as to keep the cooling water in a suitable temperature.

Non-Patent Document 1: Fuji Heavy Industries Ltd. PLEO Maintenance Manual Vol. 1, '98, 10 Page 2–70

In such an internal combustion engine, however, since the water outlet is made in a divergent structure, and has a branched structure, the main stream of the cooling water after cooling flows past the sensor without contacting it, depending on the installation location of the sensor, and therefore, accurate detection is not possible. As a result, the case occurs that the engine can not detect a temperature of the cooling water accurately.

SUMMARY OF THE INVENTION

The present invention is worked out in view of the above-described problem in the prior art. It is an object of the present invention to provide an internal combustion engine that performs its cooling by means of cooling water or coolant and is capable of detecting a temperature of the coolant accurately.

The foregoing object is accomplished by an internal combustion engine performing its cooling by means of coolant, comprising a temperature detecting means for detecting a temperature of the coolant after cooling the engine and a guidance means capable of guiding the coolant to a temperature detecting portion of the temperature detecting means. Accordingly, through this guidance means, the coolant after cooling the engine may be guided surely to the temperature detecting portion of the temperature detecting means and a temperature of the coolant may be detected accurately.

In an embodied mode of the invention, the internal combustion engine further comprises a dividing and feeding means capable of dividing and feeding the coolant after cooling the engine into the first and the second path, and the temperature detecting means is arranged at the dividing portion of the dividing and feeding means. Accordingly, the coolant may be fed to the first and the second path respectively after the coolant flows through the temperature detecting means disposed in the dividing portion, so that a temperature of the coolant may be detected accurately.

In another embodied mode of the invention, the guidance means is a rib formed within the dividing and feeding means so that the coolant flows through the temperature detecting means. Accordingly, the coolant may be guided to the temperature detecting means by a simple construction.

In a further embodied mode of the invention, the guidance means is constructed so that the height of the rib becomes lower as the rib draws near the temperature detecting means. It is therefore possible to reduce the course resistance against the coolant when it flows in the first and the second path.

In a still further embodied mode of the invention, the temperature detecting means is disposed above the dividing portion and the guidance means is constructed so that at least a part of the bottom surface of the dividing portion becomes higher as it draws near the temperature detecting means in order to guide the coolant to the temperature detecting means. Accordingly, the coolant may be guided surely to the temperature detecting portion of the temperature detecting means disposed above the dividing portion and a temperature of the coolant may be detected accurately.

In a still further embodied mode of the invention, the dividing and feeding means has a mating surface for mating with the internal combustion engine and an opened recess hollowed out from the mating surface, and a part of the opened recess is blocked so as to form the second path. Accordingly, the dividing and feeding means may be made in a simple structure.

Other advantageous features of the invention will be obvious after a reading of the following detailed description of the preferred embodiment shown in the drawings as follows.

DESCRIPTION OF THE PREFERRED EMBODIMENT

Hereinafter, an embodiment of the present invention will be described with reference to the drawings.

Figure 1:
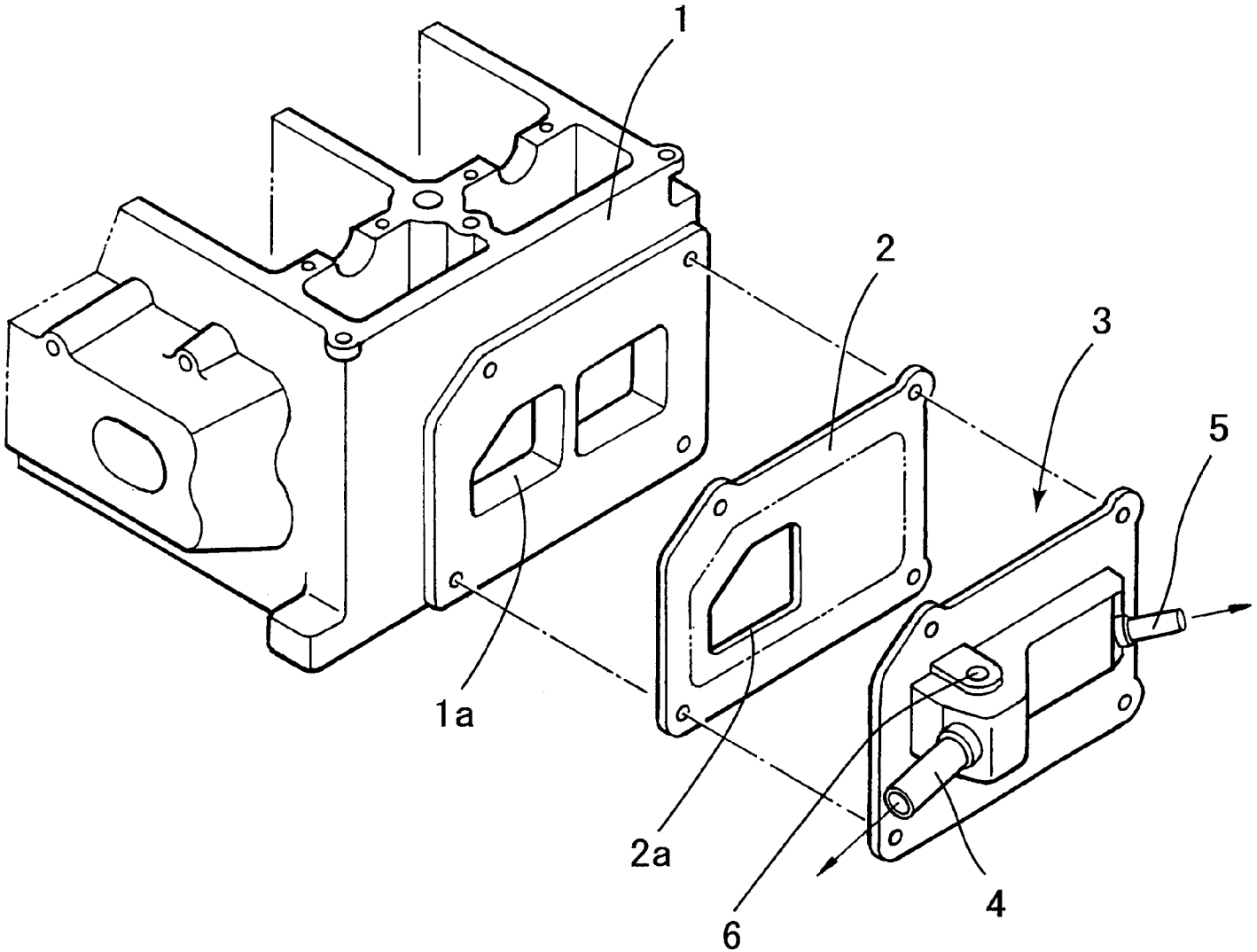
FIG. 1 is an exploded perspective view of a water outlet to be mounted on a cylinder head, as a first embodiment according to the present invention.

FIG. 1 to 4 of the drawings illustrates the first embodiment of the present invention. Referring now to FIG. 1, in the side surface of a cylinder head 1 is provided an outlet 1*a* for the coolant that has cooled the inside of the cylinder head 1 and cylinder block. To this side surface of a cylinder head 1 is securely mounted a water outlet 3 through a gasket 2 with fasteners such as bolts.

Figure 2:
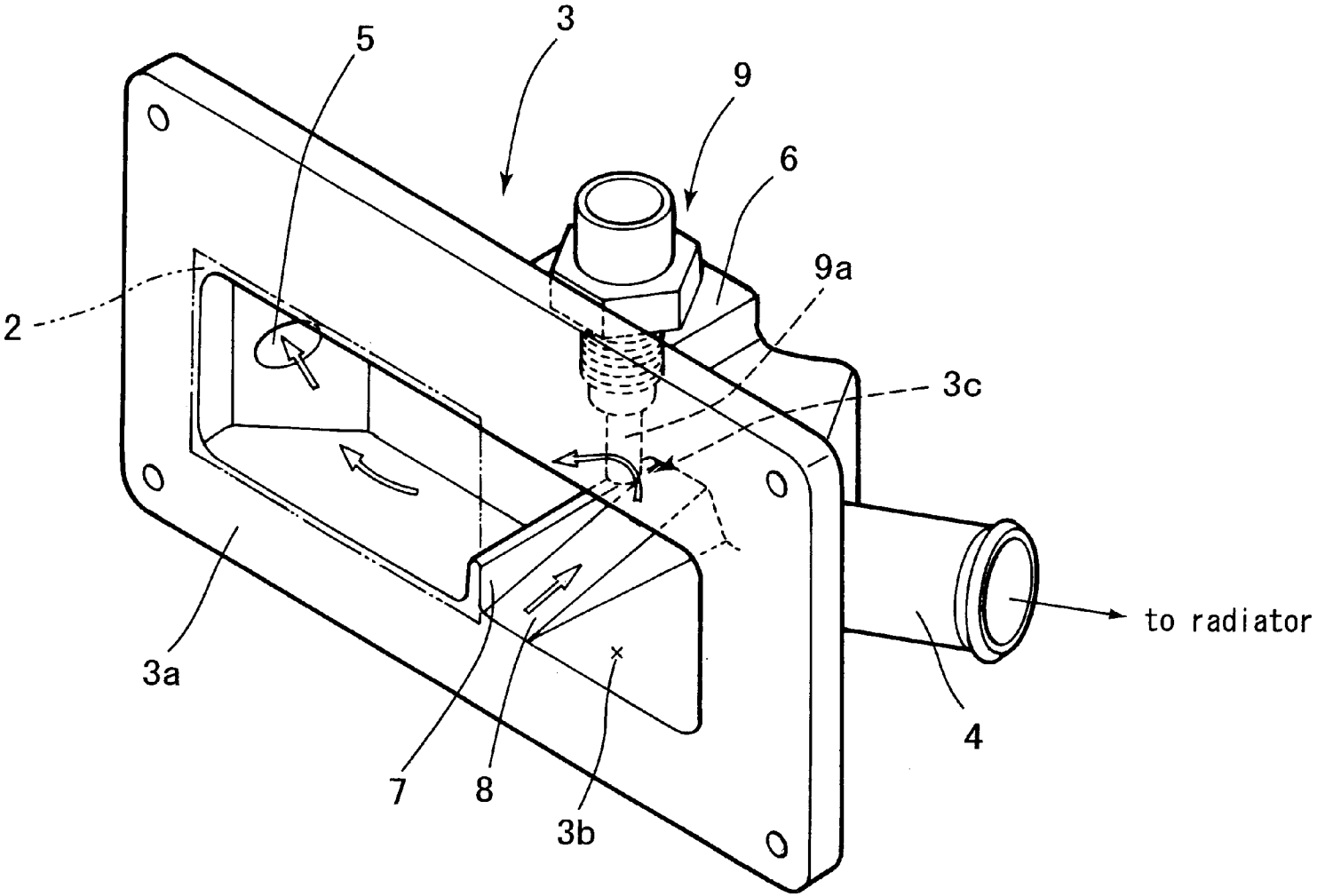
FIG. 2 is an exploded perspective view of the water outlet in FIG.1 from the cylinder head.
Figure 3:
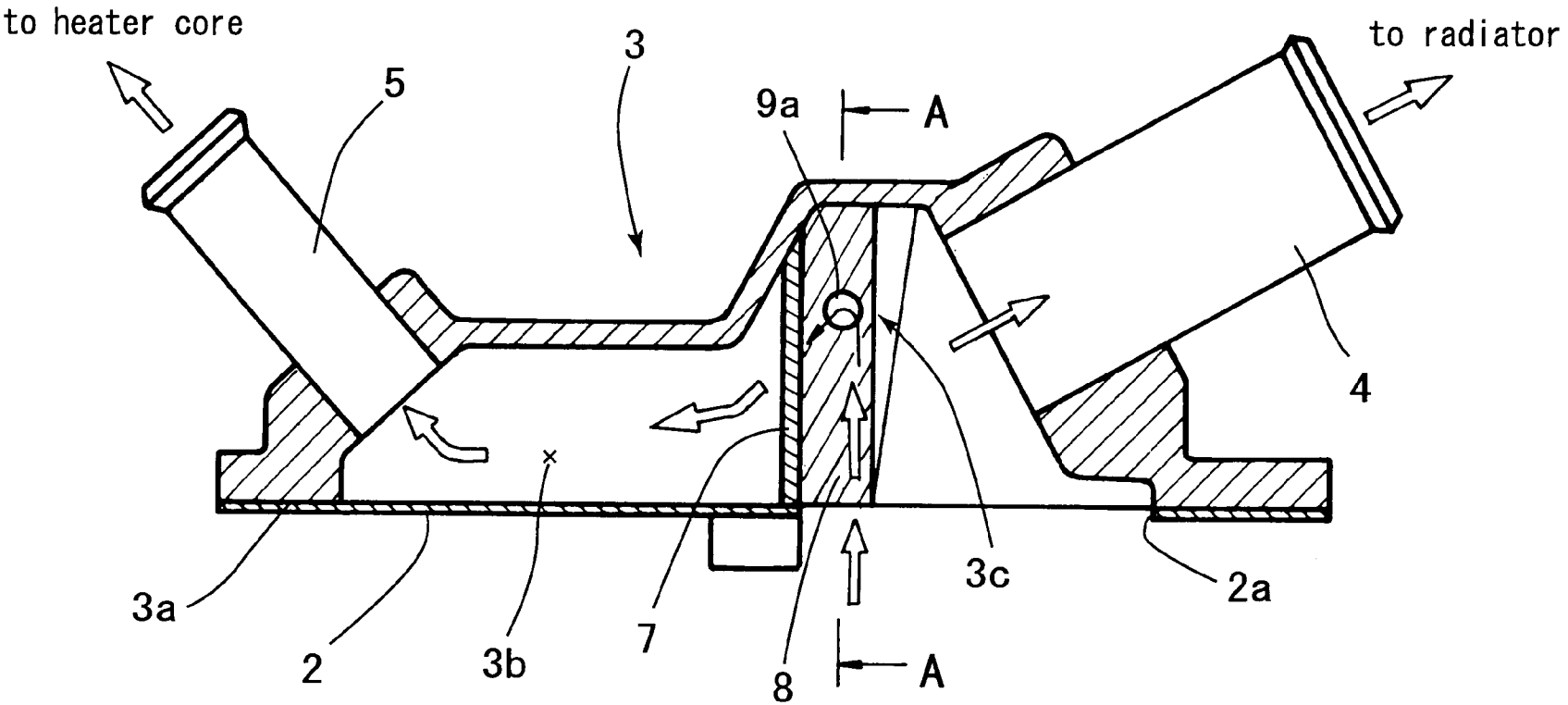
FIG. 3 is a horizontal sectional view of the water outlet in FIG. 2.
Figure 4:
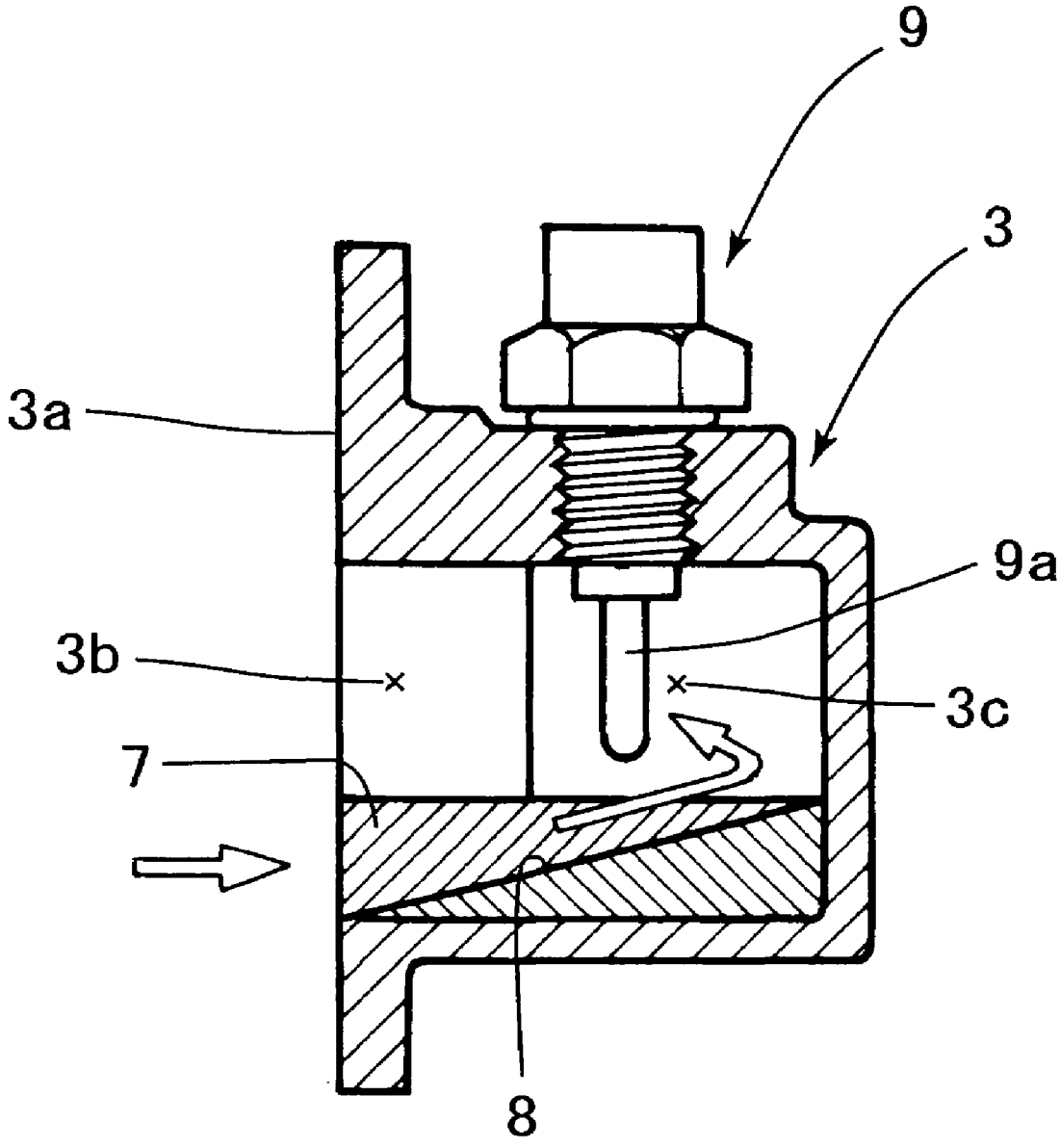
FIG. 4 is a sectional view of the water outlet taken on line A—A in FIG. 3.

Referring to FIG. 2, in the inside of this water outlet (divergent feeding means) 3 is formed an opened recess 3*b* that is hollowed out from the mating surface 3*a*, which is a surface of the water outlet 3 to be mated with the side surface of the cylinder head 1 through the gasket 2. In the opened recess 3*b* is formed a dividing portion 3*c*, by which the inside of the recess 3*b* is divided into the radiator connector side and the heater connector side, so that the coolant diverges to a radiator connector 4 and a heater connector 5 respectively. The coolant that is fed into the radiator connector 4 is returned through the radiator (not shown) to the water pump (not shown). The coolant that is fed into the heater core (not shown) from the heater connector 5 is returned to the water pump (not shown).

The side of the radiator connector 4 defines a first path and the side of the heater connector 5 defines a second path. The coolant diverges at the dividing portion 3*c* into the first and the second path respectively.

A water temperature sensor (temperature detecting means) 9 is mounted on a mounting portion 6 of the water outlet (divergent feeding means) 3. A temperature detecting portion 9*a* at the lower end of the water temperature sensor 9 is disposed facing the space above the dividing portion 3*c* within the opened recess 3*b*.

In this embodiment, for guiding the coolant precisely to the temperature detecting portion 9*a* of the water temperature sensor 9, a rib (guidance means) 7 is integrally formed on the bottom of the opened recess 3*b* extending vertically toward the temperature detecting portion 9*a*. Further, an upslope surface (guidance means) 8 is integrally formed along the rib 7 on the bottom of the recess 3*b* so that the level of the surface 8 is low at the side of the mating surface 3*a* and becomes higher as it draws near the detecting portion 9*a*.

Over the mating surface 3*a* of the water outlet 3 is laid the gasket 2, which blocks the second path of the opened recess 3*b* in the left side of the rib 7 (as illustrated). Accordingly, the coolant flows through an opening 2*a* formed in the gasket 2 into the first path (radiator connector side) of the opened recess 3*b* of the water outlet 3.

In the foregoing construction, the coolant that has cooled the inside of the cylinder head 1 and cylinder block flows from the coolant outlet 1*a* of the cylinder head 1 through the opening 2*a* of the gasket 2 into the first path of the opened recess 3*b* in the water outlet 3. The coolant in the first path flows to the inner part ascending the upslope surface 8 and at the dividing portion 3*c* one of the divided coolant flows to the radiator connector 4, while the other coolant climbs over the rib 7 flowing into the second path toward the heater connector 5 since the height of the rib 7 is almost the same to that of the upslope surface 8 at the inner part.

Accordingly, the coolant is well guided along the upslope surface 8 and rib 7 to the temperature detecting portion 9*a* of the water temperature sensor 9, where the coolant is divided, so that the water temperature of the coolant may be accurately detected by the temperature detecting portion 9*a*. As a result, the water temperature sensor 9 is capable of detecting the temperature of the coolant accurately, and depending on the detected temperature the coolant may be controlled to an appropriate temperature by controlled rotation of the cooling motor fan.

Although in this embodiment there is illustrated a water outlet 3 provided integrally with the rib 7 and the upslope surface 8, alternatively it may be provided with the rib 7 only. In this case, the rib 7 should be constructed so that its height may be high at the side of the mating surface 3*a* and may become lower as it draws near the temperature detecting portion 9*a*. Thereby, it becomes possible to reduce the resistance against the flow of coolant while it flows through the first and the second path.

As described above, in such a simple construction as that the rib 7 and/or the upslope surface 8 are integrally formed within the water outlet 3, the coolant may be well guided to the temperature detecting portion 9*a* and the water temperature of the coolant may be detected accurately.

Figure 5:
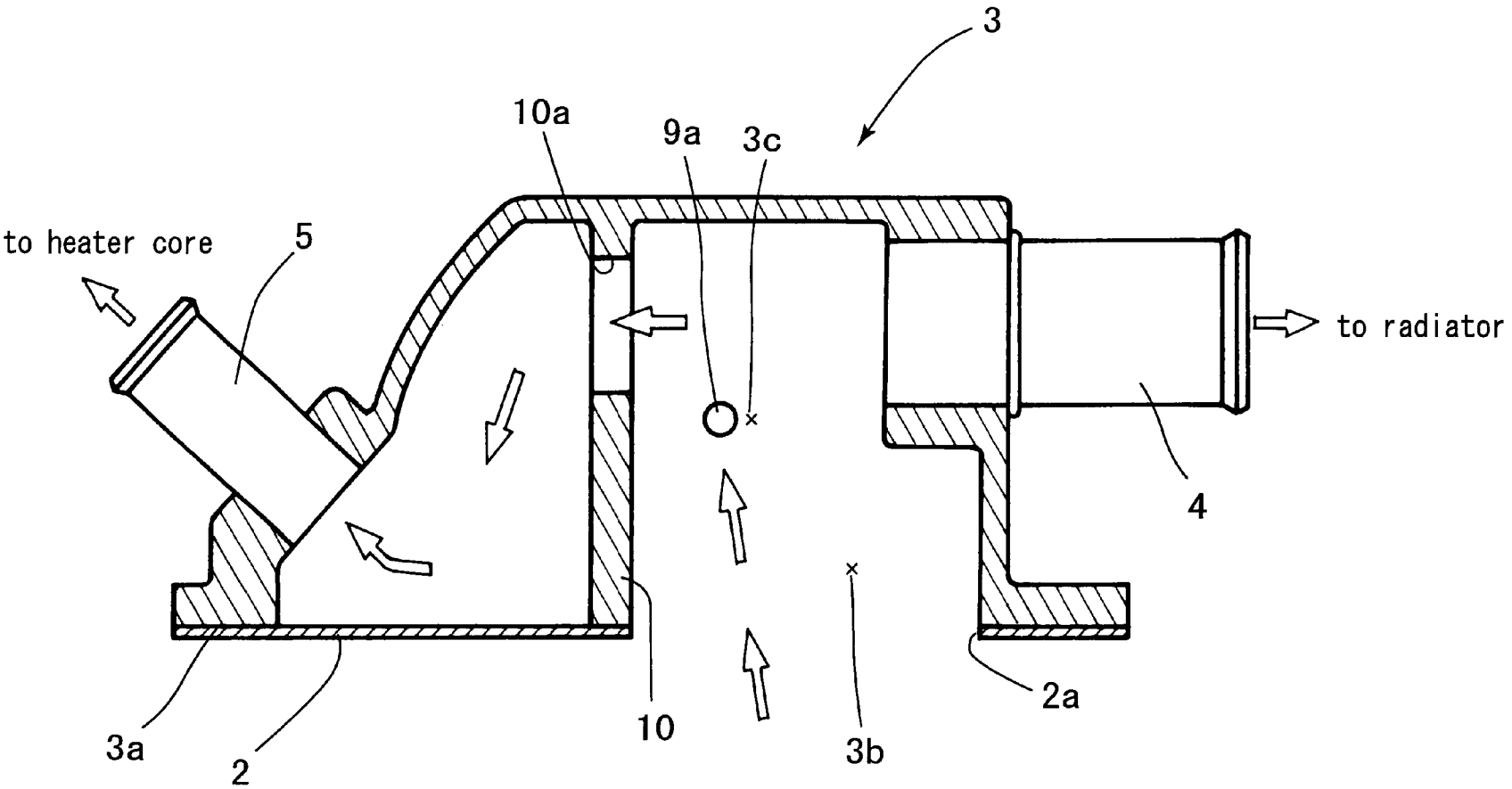
FIG. 5 is a horizontal sectional view of a water outlet, as a second embodiment according to the present invention.

Next, referring to FIG. 5, there is shown a horizontal sectional view of a water outlet 3 as the second embodiment. In this water outlet (dividing and feeding means) 3, an opened recess 3*b* is divided by a partition 10 into the first path (the side of a radiator connector 4) and the second path (the side of a heater connector 5). In the inner part of the partition 10 is provided a guidance hole 10*a* (guidance means) making the first and the second path communicate with each other.

On the mating surface 3*a* in the second path is laid a gasket 2 to block the course, so that the second path may communicate with the first path only through the guide hole 10*a* of the partition 10. In the inner part of the opened recess 3*b* on the side of this first path is formed a dividing portion 3*c*, above which is disposed a temperature detecting portion 9*a* of a water temperature sensor 9. Namely, the temperature detecting portion 9*a* is arranged near the guide hole 10*a* on the side of the first path.

The water outlet 3 of such a simple construction as described above may be produced by forming the guidance hole 10*a* with a drill or the like inserted from the side of the radiator connector 4. The coolant that flowed in the opened recess 3*b* from the cylinder head 1 diverges at the dividing portion 3*c* to the radiator connector 4 (the first path) and the heater connector 5 (the second path) through the guidance hole 10*a*. Then, the coolant passes through the temperature detecting portion 9*a* of the water temperature sensor 9 disposed near the guidance hole 10*a*, so that the water temperature of the coolant is surely detected at the temperature detecting portion 9*a*.

Figure 6:
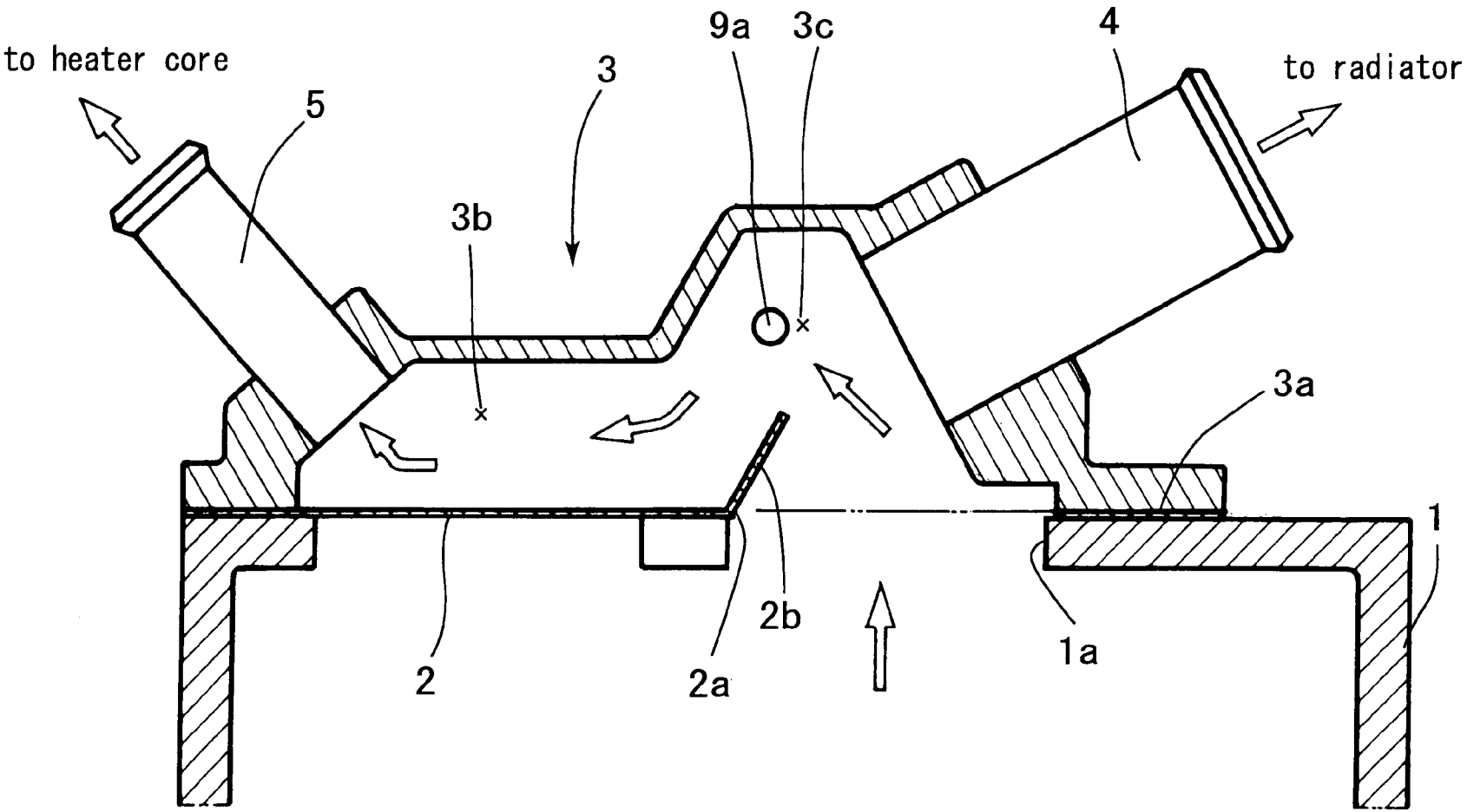
FIG. 6 is a horizontal sectional view of a water outlet, as a third embodiment according to the present invention.
Figure 7:
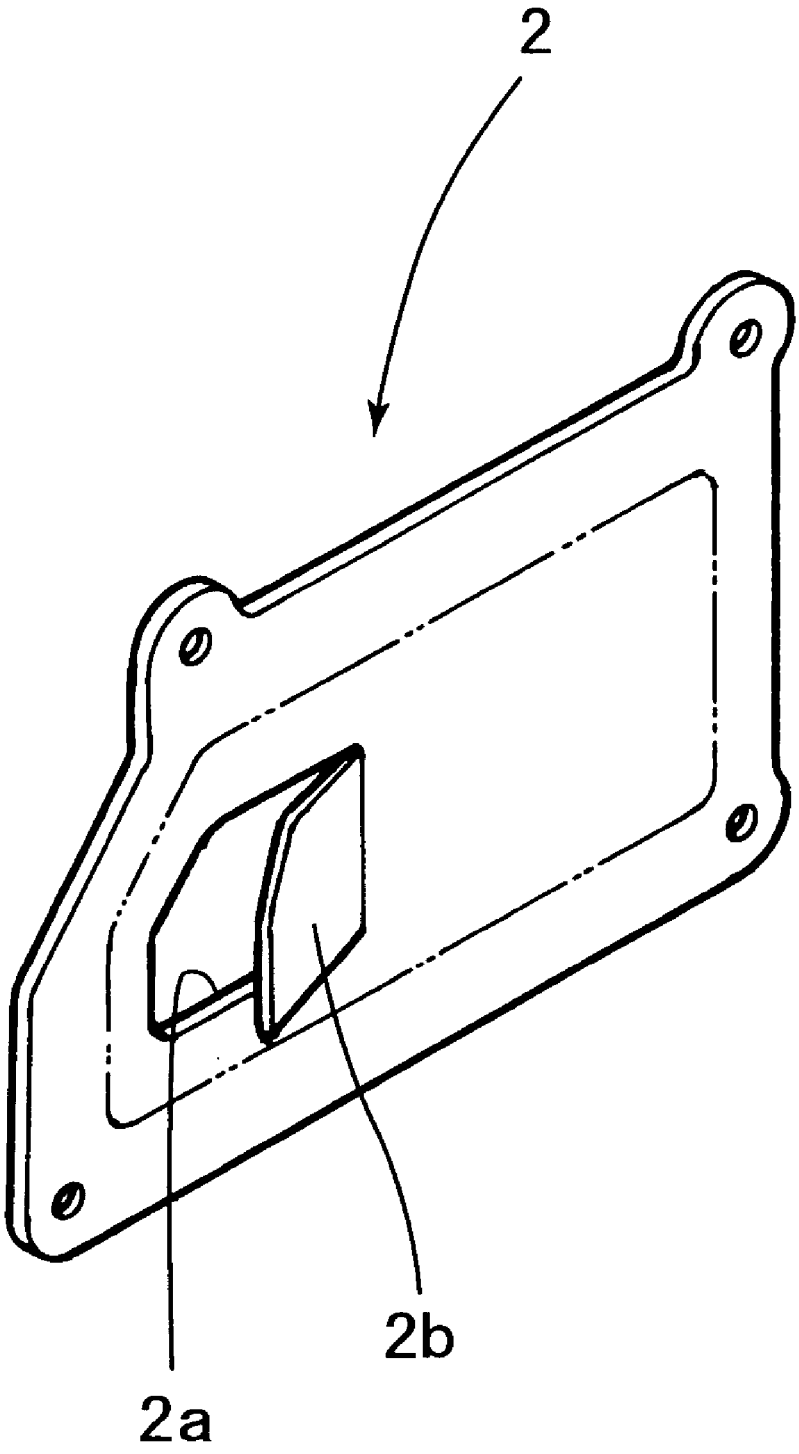
FIG. 7 is a perspective view of the gasket in FIG. 6.

Next, referring to FIG. 6, there is shown a horizontal sectional view of a water outlet 3 as the third embodiment. In this water outlet 3, a gasket 2 is used as shown in FIG. 7. The gasket 2 is integrally provided with a guidance rib 2*b* in the opening 2*a*. This guidance rib 2*b*, in the assembled condition, is arranged inclining toward the dividing portion 3*c* in the opened recess 3*b*, as shown in FIG. 6. Accordingly, the coolant is well guided to the temperature detecting portion 9*a* of the water temperature sensor 9 arranged above the dividing portion 3*c*.

Consequently, with the guide by this guidance rib 2*b* (guidance means), the coolant that is flowing into the opened recess 3*b* of the water outlet 3 may pass through the temperature detecting portion 9*a* of the water temperature sensor 9 to be divided to the radiator connector 4 (the first path) and the heater connector 5 (the second path). As a result, the temperature of the coolant may be detected accurately by the temperature detecting portion 9*a*.

What is claimed is:

1. An internal combustion engine performing its cooling by means of coolant, comprising:

a temperature detecting means having a temperature detecting portion for detecting a temperature of the coolant after cooling said internal combustion engine;

and a guidance means capable of guiding said coolant to said temperature detecting portion;

and a dividing and feeding means capable of dividing and feeding said coolant after cooling the engine into a first and second path; and wherein said guidance means is a rib formed within said dividing and feeding means so that coolant may flow through said temperature detecting means.

2. An internal combustion engine as defined in claim 1, wherein said temperature detecting means is arranged at the dividing portion of said dividing and feeding means.

3. An internal combustion engine as defined in claim 1 wherein said guidance means is constructed so that the height of said rib becomes lower as said rib draws near said temperature detecting means.

4. An internal combustion engine as defined in claim 2, wherein said temperature detecting means is disposed above said dividing portion and said guidance means is constructed so that at least a part of the bottom surface of said dividing portion becomes higher as it draws near said temperature detecting means in order to guide said coolant to said temperature detecting means.

5. An internal combustion engine as defined in claim 1, wherein said dividing and feeding means has a mating surface for mating with said internal combustion engine and an open recess hollowed out from said mating surface, and a part of said opened recess is blocked so as to form said second path.

* * * * *